US007467656B2

(12) United States Patent
Wobker et al.

(10) Patent No.: US 7,467,656 B2
(45) Date of Patent: Dec. 23, 2008

(54) LIQUID-COOLED PERMANENT MOLD FOR THE CONTINUOUS CASTING OF METALS

(75) Inventors: Hans-Günter Wobker, Bramsche (DE); Gerhard Hugenschütt, Belm (DE); Thomas Rolf, Osnabrück (DE)

(73) Assignee: KME Germany AG & Co. KG, Osnabrück (DE)

( * ) Notice: Subject to any disclaimer, the term of this patent is extended or adjusted under 35 U.S.C. 154(b) by 0 days.

(21) Appl. No.: 11/448,500

(22) Filed: Jun. 6, 2006

(65) Prior Publication Data

US 2006/0272794 A1 Dec. 7, 2006

(30) Foreign Application Priority Data

Jun. 7, 2005 (DE) ..... 10 2005 026 329

(51) Int. Cl.
*B22D 11/00* (2006.01)
*B22D 11/055* (2006.01)

(52) U.S. Cl. ..... 164/443; 164/418

(58) Field of Classification Search ..... 164/418, 164/459, 485, 443
See application file for complete search history.

(56) References Cited

U.S. PATENT DOCUMENTS

2002/0185253 A1* 12/2002 Yamasaki et al. ..... 164/418
2004/0069439 A1* 4/2004 Hugenschutt et al. ..... 164/418
2004/0069440 A1* 4/2004 Hugenschutt et al. ..... 164/418

FOREIGN PATENT DOCUMENTS

DE 102 37 472 2/2004

* cited by examiner

*Primary Examiner*—Kuang Lin
(74) *Attorney, Agent, or Firm*—Kenyon & Kenyon LLP

(57) ABSTRACT

A liquid-cooled permanent mold for the continuous casting of metals, comprising mold plates (1) made of copper or a copper alloy, which are connected respectively to an adapter plate or a water-cooling tank by clamping bolts, the clamping bolts being fastened to plateau pedestals (3) that protrude in an insular fashion from the coolant side (2), which at least partially extend into a coolant gap formed between the mold plate (1) and the adapter plate or the cooling-water tank, and have a streamlined form adjusted to the flow direction of the coolant. The coolant side (2) has cooling ribs (4, 5, 6, 7) that extend into the coolant gap and are situated from place to place between two adjacent plateau pedestals (3).

16 Claims, 3 Drawing Sheets

LIQUID-COOLED PERMANENT MOLD FOR THE CONTINUOUS CASTING OF METALS

BACKGROUND OF THE INVENTION

1. Field of the Invention

The invention relates generally to a liquid-cooled permanent mold for the continuous casting of metals.

2. Description of Related Art

Such a mold is known from DE 102 37 472. In the application of such mold plates in continuous casting plants, because of the high heat supply from the casting process, unexpectedly high local thermal loads may occur in response to certain process parameters.

SUMMARY OF THE INVENTION

It is an object of the invention to improve a liquid-cooled mold, of the type named at the outset, with respect to its cooling performance, in order to prevent thermal overloads and to increase its service life.

This and other objects of the invention are achieved by a liquid-cooled permanent mold for the continuous casting of metals, comprising mold plates (1, 1*a*) made of copper or a copper alloy, which are connected respectively to an adapter plate or a water-cooling tank by clamping bolts, the clamping bolts being fastened to plateau pedestals (3) that protrude in an insular fashion from the coolant side (2), which at least partially extend into a coolant gap formed between the mold plate (1, 1*a*) and the adapter plate or the cooling-water tank, and have a streamlined form adjusted to the flow direction (S) of the coolant, wherein the coolant side (2) has cooling ribs (4, 5, 6, 6*a-d*, 7, 7*a*, 11) that extend into the coolant gap and are situated from place to place between two adjacent plateau pedestals (3).

BRIEF DESCRIPTION OF THE DRAWINGS

The present invention will be described in greater detail with reference to the following drawings wherein.

DETAILED DESCRIPTION OF THE INVENTION

Figure 1:
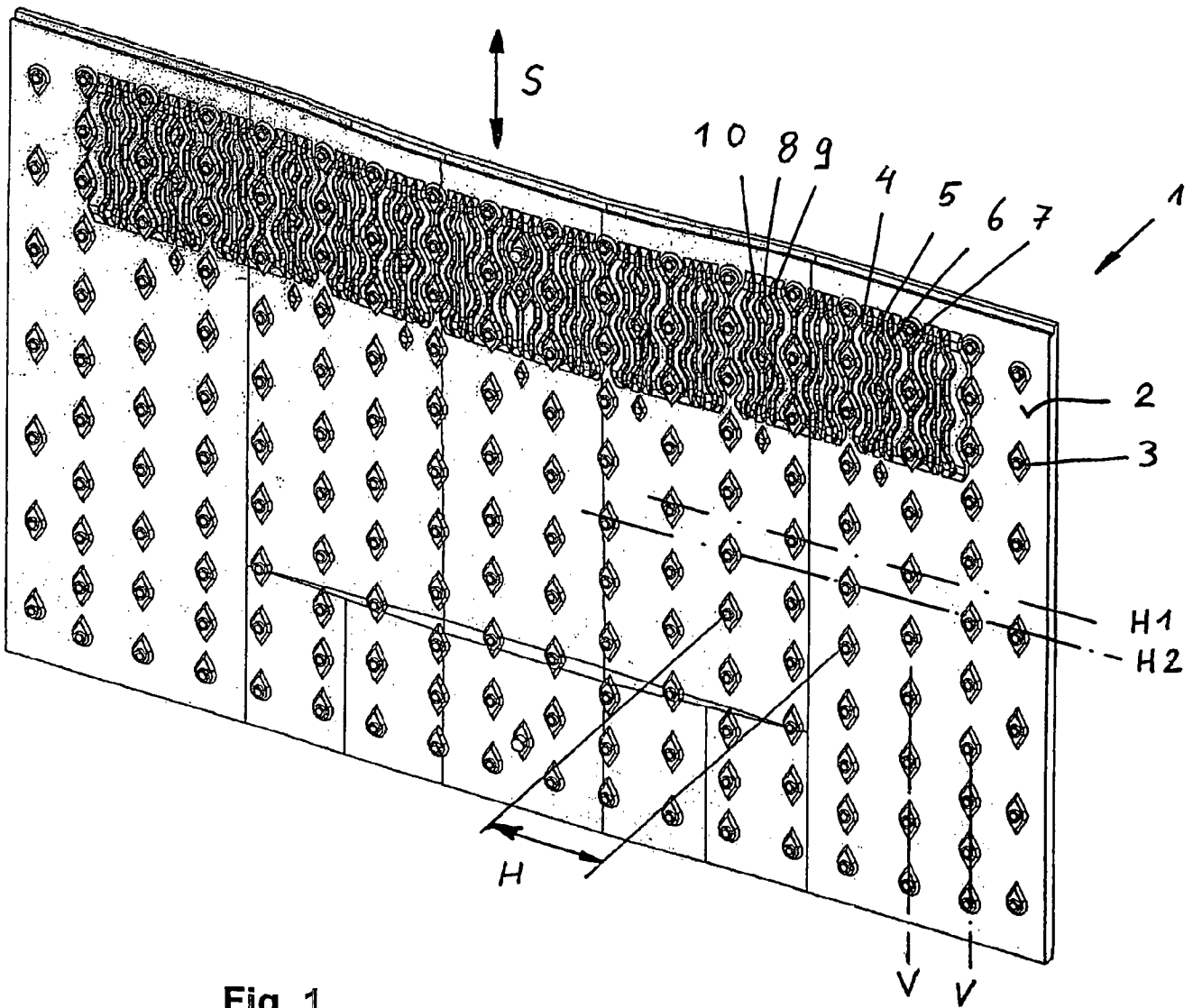
FIG. 1 shows a representation in perspective of the rear view of a first specific embodiment of a mold plate in the direction of view onto the plateau pedestal.

For the local increase in the cooling effect of the liquid-cooled mold, it is provided that the coolant side have cooling ribs that extend into the coolant gap and are situated from area to area between two adjacent plateau pedestals.

Cooling ribs within the meaning of the present invention are crosspiece-like elevations that point in the same direction as the plateau pedestals. The cooling ribs extend at least partially into the coolant gap, that is, they are raised compared to the coolant side, just as the plateau pedestals. The height of the cooling ribs, and with that the contact area with the coolant, may be increased by inserting a groove between two cooling ribs in the coolant side. In this way, the flow cross section diminished by the cooling ribs may at least partially be enlarged again, so that, even without reducing the flow cross section, an improved cooling effect is achieved in the region provided with the cooling ribs.

However, basically the aim is to reduce the flow cross section with the objective of increasing the flow speed of the coolant. This produces a locally improved heat transfer from the mold plate to the coolant, and thus an improved cooling of the mold in this area. In addition, because of the cooling ribs, the cooling surface is increased in these area, whereby improved cooling also comes about.

Because of the improved cooling, it is possible to reduce the plate thickness of the mold plate in this area. This results in a lesser distance between the so-called hot side that faces the melt and the coolant. The flow cross section itself is not narrowed down by the reduction of the plate thickness, that is, the width of the coolant gap remains the same. Changes in cross section come about only by the cooling ribs that are provided, by which the temperature level is lowered in this thickness-reduced zone.

The cooling ribs are situated especially in the area of the bath level of the mold, since at that place, according to experience, the highest thermal loads occur.

As a general principle, the cooling ribs should be dimensioned in such a way that the pressure losses within the coolant gap do not become too great. In the case of too great a pressure loss, there is the danger that vapor bubbles may appear, whereby the heat transfer deteriorates considerably. There is also the danger that, in response to too great a pressure loss, a reduction in the coolant quantity, that is, the volume flow, takes place. The volume flow cannot be increased at will, because of a specified maximum pressure.

As a general principle, it is possible to situate the cooling ribs parallel to the flow direction of the coolant within the coolant gap. However, in an expedient manner, the cooling ribs have longitudinal sections that are at an angle to the flow direction. In this connection, an angle range up to 45° is regarded as expedient. The selected angle may vary over the longitudinal extension of the cooling rib, that is, even a serpentine-shaped curve is conceivable. Because of the bending at least from place to place, or the sequence in curves, flow turbulences may additionally be generated, which improve the heat transfer between the coolant side of the mold plate and the coolant. Serpentine-shaped cooling ribs have the advantage that they may be adapted in their course to the contour of the streamlined plateau pedestal.

In an advantageous embodiment of the idea of the invention, adjacent cooling ribs and flow channels formed by cooling ribs and adjacent plateau pedestals have a cross section that remains the same over the longitudinal extension of the cooling ribs, so as to limit the pressure losses within the flow channels.

In an advantageous further development, the plateau pedestals may be aligned in vertical rows and aligned in horizontal rows, the plateau pedestals of two successive horizontal rows being situated offset to each other in the horizontal direction. This creates a partial compensation for the greater pressure losses of the coolant resulting from the cooling ribs. In response to the situation of the plateau pedestal in horizontal and vertical rows, without successive horizontal rows being offset with respect to one another, a pulsing coolant flow comes about, since the coolant flow experiences recurring narrowing and widening of the cross section in the direction of flow. This undesired effect may be reduced by positioning the plateau pedestals of successive horizontal rows offset to one another in the horizontal direction. The pulsing of the coolant stream is at its least if the plateau pedestals of two successive horizontal rows is offset to one another by half the horizontal distance between adjacent plateau pedestals. In such a positioning, the flow resistance is also at its lowest.

FIG. 1 shows a mold plate 1 which is fastened to an adapter plate that is not shown in greater detail. The mold plate 1 and the adapter plate form a plate unit of a liquid-cooled mold for the continuous casting of metals that is not shown in greater detail. Mold plate 1 is made of copper or a copper alloy, preferably having a yield strength of >350 Mpa, the strength basically also being able to be lower. Mold plate 1 has an uneven wall thickness. Alternatively, the mold plate has a uniform wall thickness over its entire extension.

For the cooling of mold plate 1 using coolants, a coolant gap is provided, between mold plate 1 and the adapter plate, whose height is determined by plateau pedestals 3 that protrude above coolant side 2. Plateau pedestals 3 have an essentially rhombic configuration, and are thus favorably adapted to flow direction S of the coolant, from a flow technology point of view. In this exemplary embodiment, plateau pedestals 3 are formed as one piece with mold plate 1.

What is essential is that, in mold plate 1 according to the present invention, cooling ribs 4, 5, 6 are situated on the coolant side, from place to place situated between adjacent plateau pedestals 3. Cooling ribs 4, 5, 6, 7 extend essentially in flow direction S of the coolant, and are situated in the area of the bath level of the metal melt. In this exemplary embodiment, cooling ribs 4, 5, 6, 7 extend over a height range encompassed by three plateau pedestals. To be sure, cooling ribs 4, 5, 6, 7 are basically aligned in flow direction S, but they run in serpentine fashion, that is, they have a plurality of curves. The position of the curves is adapted to the positioning of plateau pedestals 3. Thereby flow channels 8, 9, 10 come about having constant cross sections. Flow channels 8, 9, 10 are formed both by cooling ribs 4, 5, 6, 7 adjacent to one another as well as by cooling ribs 4, 5, 6, 7 at adjacent plateau pedestals 3.

It may be seen that plateau pedestals 3 are situated aligned in vertical rows V as well as aligned in horizontal rows H1, H2. Plateau pedestals 3 of two successive horizontal rows H1, H2 are situated offset with respect to one another in the horizontal direction. In this exemplary embodiment, the plateau pedestals of horizontal rows H1 and H2 are situated offset by one-half the horizontal clearance H with respect to one another.

Figure 2:
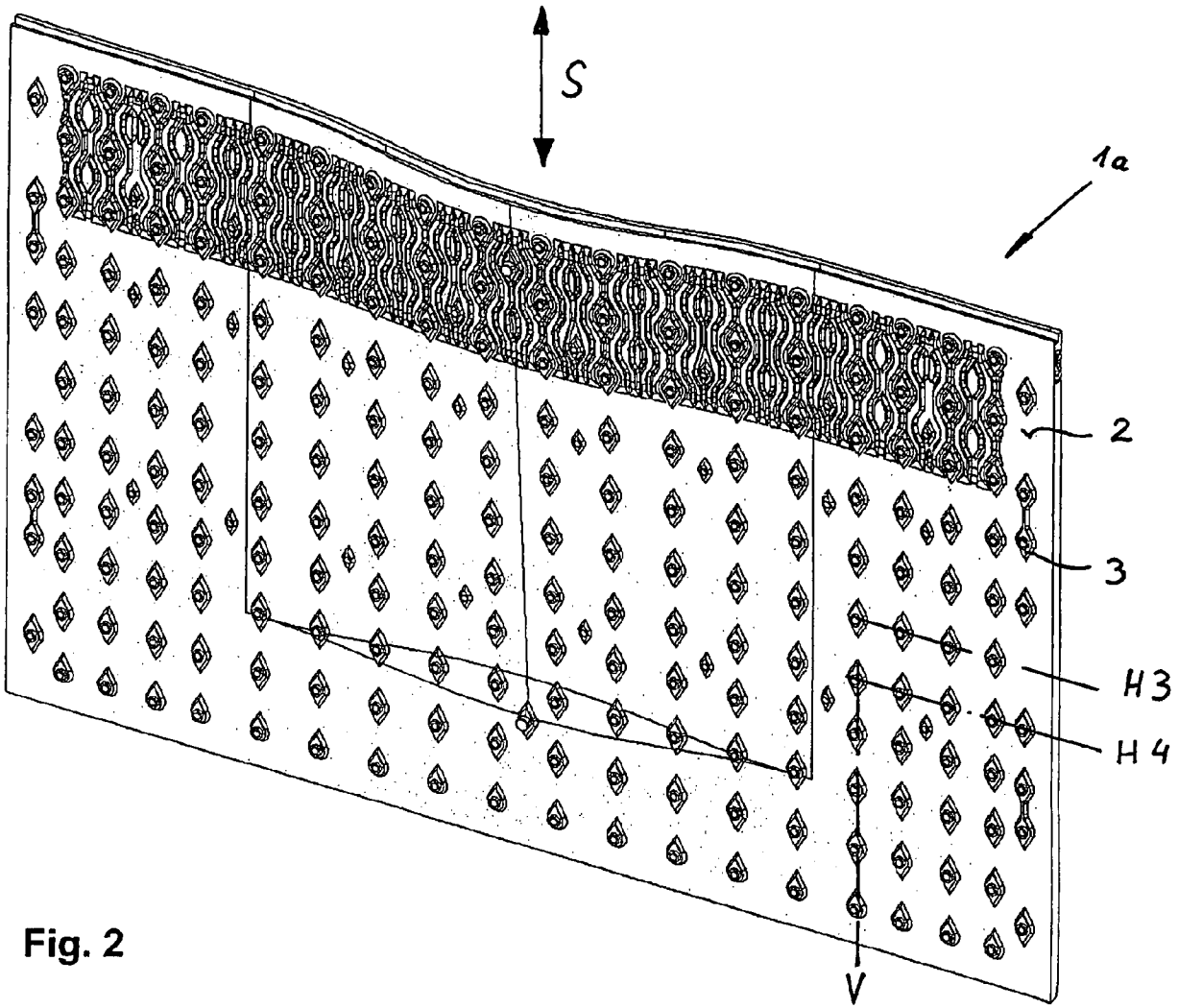
FIG. 2 shows an additional specific embodiment of such a mold plate corresponding to the representation in FIG. 1.

Mold plate 1*a* in FIG. 2 essentially corresponds to the one in FIG. 1, the difference being that plateau pedestals 3 of two successive horizontal rows H3, H4 are not offset with respect to each other in the horizontal direction.

Figure 3:
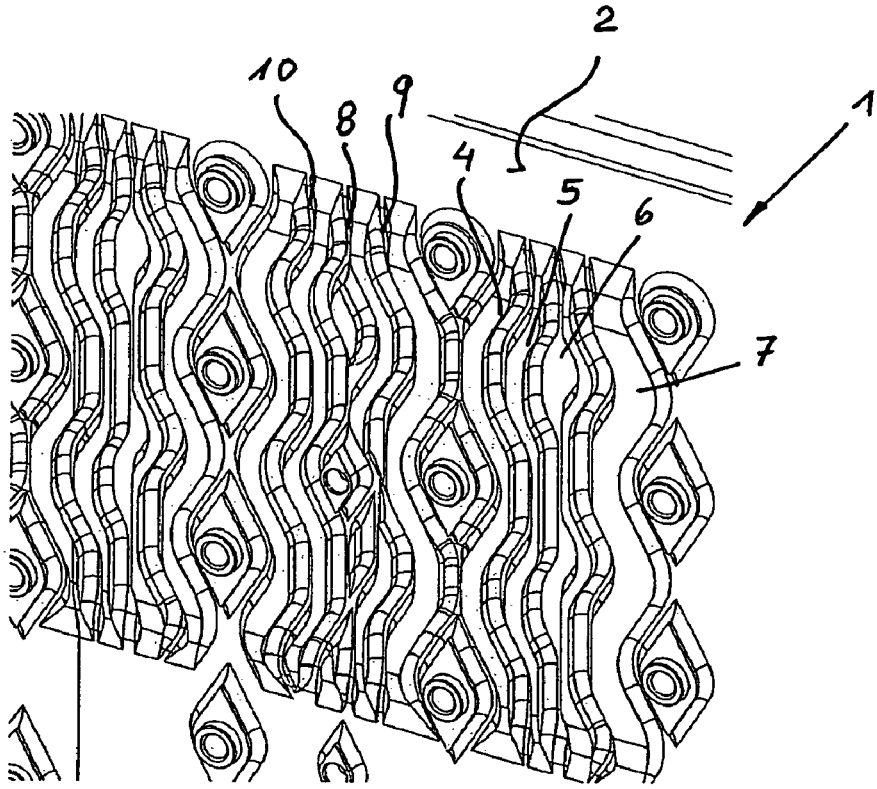
FIG. 3 shows an enlarged cutout of the mold plate of FIG. 1.

FIG. 3 shows an enlarged cutout of the area of mold plate 1 provided with cooling ribs 4, 5, 6, 7, from which one may see more clearly the course of cooling ribs 4, 5, 6, 7 and flow channels 8, 9, 10. It may be seen that the width of the different flow channels 8, 9, 10 is essentially constant over its entire length, while the width of cooling ribs 4, 5, 6, 7 may vary quite a bit over their longitudinal extensions, and insular areas of a cooling rib may come about which may be recognized especially well with the aid of FIG. 4.

Figure 4:
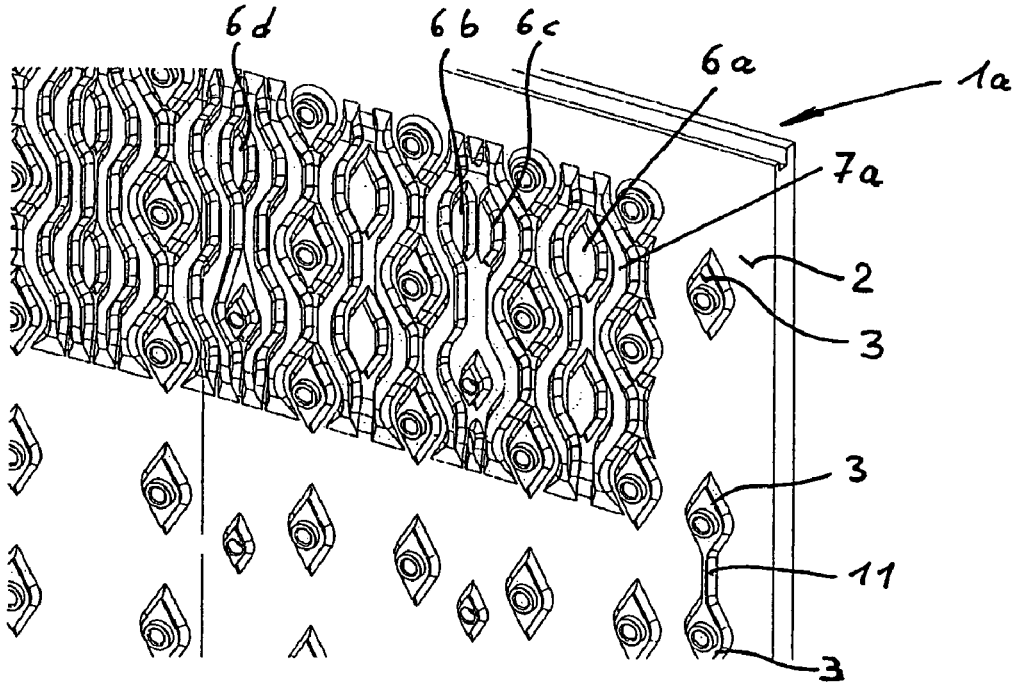
FIG. 4 shows an enlarged cutout of the mold plate of FIG. 2.

Based on the different arrangement of plateau pedestals 3 in FIG. 4, another pattern of cooling ribs and flow channels also comes about, two to four cooling ribs being situated next to one another, depending on the horizontal distance between two plateau pedestals, which get thicker and taper down in their longitudinal extension. In this exemplary embodiment, the cooling ribs have different lengths. This may be recognized best from looking at cooling ribs 6*a* and 7*a*. Cooling rib 6*a* has a similar contour to a plateau pedestal 3, and is therefore substantially shorter than adjacent cooling rib 7*a*. Approximately at the same height as cooling rib 6*a*, there are two additional cooling ribs 6*b*, 6*c*, which in their overall contour perhaps correspond to the pedestal-like cooling rib 6*a*, but are centrically divided in the flow direction, so that there is a flow channel between cooling ribs 6*b*, 6*c*. A little further to the left in the image plane, a substantially narrower plateau pedestal-like cooling rib 6*d* may be seen. The exact contour of the respective cooling ribs and flow channels comes about due to the requirements of flow technology, and is adapted individually to the respective mold plate, that is, essentially to the arrangement of plateau pedestals 3.

At the right in the plane of the image it may be seen that two plateau pedestals 3 are connected to each other in the flow direction, that is, in the vertical direction, lying one behind the other, by a cooling rib 11 extending in the flow direction.

What is claimed is:

1. A liquid-cooled permanent mold for the continuous casting of metals, comprising: mold plates made of copper or a copper alloy, which are connected respectively to an adapter plate or a water-cooling tank by clamping bolts, the clamping bolts being fastened to plateau pedestals that protrude in an insular fashion from the coolant side, which a least partially extend into a coolant gap formed between the mold plate and the adapter plate or the cooling-water tank, wherein the coolant side has cooling ribs that extend into the coolant gap and are situated from place to place between two adjacent plateau pedestals, wherein the cooling ribs are dimensioned in such away that the flow cross section of the coolant gap in areas provided with cooling ribs is smaller than the flow cross section in areas without cooling ribs sufficient to assure an increase in the speed of coolant flowing through the cross section in areas with the cooling ribs relative to the cross section with out cooling ribs.

2. The permanent mold according to claim 1, wherein the mold plate has a reduced wall thickness in the area of the cooling ribs.

3. The permanent mold according to claim 1, wherein the flow cross section is reduced by the cooling ribs sufficient to increase the speed of coolant flowing through the coolant gap in areas with the cooling ribs but below a speed at which vapor bubbles may appear.

4. The permanent mold according to claim 2, wherein the flow cross section is reduced by the cooling ribs sufficient to increase the speed of coolant flowing through the coolant gap in areas with the cooling ribs but below a speed at which vapor bubbles may appear.

5. The permanent mold according to claim 1, wherein the cooling ribs are situated at the height range of the bath level.

6. The permanent mold according to claim 2, wherein the cooling ribs are situated at the height range of the bath level.

7. The permanent mold according to claim 1, wherein the cooling ribs of (i) have a streamlined form adjusted to a flow direction of the coolant or (ii) are oriented parallel to the flow direction.

8. The permanent mold according to claim 2, wherein the cooling ribs of (i) have a streamlined form adjusted to a flow direction of the coolant or (ii) are oriented parallel to the flow direction.

9. The permanent mold according to claim 1, wherein the cooling. ribs have longitudinal sections which are at an angle to the flow direction.

10. The permanent mold according to claim 2, wherein the cooling ribs have longitudinal sections which are at an angle to the flow direction.

11. The permanent mold according to claim 9, wherein the cooling ribs run in serpentine form in their longitudinal extension.

12. The permanent mold according to claim 11, wherein the serpentine-formed cooling ribs are adapted in their course to the contour of the plateau pedestals.

13. The permanent mold according to claim 1, wherein the flow channels having a constant cross section in the flow direction are formed by cooling ribs that are adjacent to one another and by cooling ribs and adjacent plateau pedestals.

14. The permanent mold according to claim 2, wherein the flow channels having a constant cross section in the flow direction are formed by cooling ribs that are adjacent to one another and by cooling ribs and adjacent plateau pedestals.

15. The permanent mold according to claim 1, wherein the plateau pedestals are situated aligned in vertical rows and aligned in horizontal rows, the plateau pedestals of two successive horizontal rows are situated offset with respect to one another in the horizontal direction.

16. The permanent mold according to claim 15, where in the plateau pedestals of two successive horizontal rows are situated offset with respect to each other by one-half the horizontal distance of adjacent plateau pedestals.

* * * * *